US005758527A

United States Patent [19]

Crepinsek

[11] Patent Number: 5,758,527

[45] Date of Patent: Jun. 2, 1998

[54] HIGH SECURITY DEADBOLT LOCK ASSEMBLY

[75] Inventor: Alois Crepinsek, Chandler, Ariz.

[73] Assignee: Securitron Magnalock Corp., Sparks, Nev.

[21] Appl. No.: 632,070

[22] Filed: Apr. 15, 1996

[51] Int. Cl.[6] ..... E05C 1/06; E05B 17/04

[52] U.S. Cl. ..... 70/379 R; 292/139; 292/2; 292/169.15; 292/DIG. 52; 70/129; 70/134

[58] Field of Search ..... 70/379 R, 107, 70/129, 134, 143, 417, DIG. 42, DIG. 60; 292/2, 139, 169.13, 169.14, 169.15, 346, DIG. 52, 167, 169

[56] References Cited

U.S. PATENT DOCUMENTS

| | | | |
|---|---|---|---|
| 1,159,635 | 11/1915 | Wolfe et al. | 292/DIG. 52 |
| 1,846,364 | 12/1932 | Schlage | 292/2 |
| 2,661,972 | 12/1953 | Schlage | 292/169.13 |
| 3,702,549 | 11/1972 | Solovieff et al. | 292/139 |
| 3,794,366 | 2/1974 | Graham | 292/169.14 |
| 4,012,929 | 3/1977 | Solovieff | 292/139 |
| 4,268,075 | 5/1981 | Allenbaugh | 292/167 |
| 4,422,677 | 12/1983 | Gater | 292/139 |
| 4,679,418 | 7/1987 | Allen | 70/380 |

FOREIGN PATENT DOCUMENTS

| | | | |
|---|---|---|---|
| 2340580 | 2/1975 | Germany | 292/169.13 |
| 146014 | 6/1954 | Sweden | 292/169 |
| 496776 | 12/1938 | United Kingdom | 292/169.15 |
| 761691 | 11/1956 | United Kingdom | 70/143 |

*Primary Examiner*—Darnell M. Boucher
*Attorney, Agent, or Firm*—Gregory J. Nelson

[57] ABSTRACT

A high security deadbolt assembly for a door which bolt has a housing extending from the edge of the door inwardly of the transverse bore between the door surface. A deadbolt is reciprocable in the housing and has a recess at its inner end. A cylindrical drive member is rotatively supported in the housing and is located with or is aligned with the deadbolt recess. The drive member carries a stop and is connected to the bolt by a linkage. When locked, a substantial portion of the length of the bolt remains engaged in the bolt housing and door so that attempts at forcing the bolt to the unlocked position are resisted by the stop which stop engages an internal surface of the bolt recess. The components are made from high strength materials and the deadbolt assembly may be retrofit to existing lock cylinders with a minimum of installation modifications.

13 Claims, 4 Drawing Sheets

HIGH SECURITY DEADBOLT LOCK ASSEMBLY

BACKGROUND OF THE INVENTION

1. Field of the Invention

The present invention relates to door-mounted locks and more particularly relates to a high security door locks of the type commonly known as deadbolts.

2. Prior Art

Deadbolt locks are the type of lock that normally require key actuation in both directions of operation as contrasted to other types of locks such as spring locks. Deadbolts are generally regarded as being more secure than most other types of locks. Because of their increased security, deadbolt locks are widely used as a deterrent to burglaries and break-ins. Conventionally, deadbolt lock assemblies have been fabricated having a structure which includes several sections mechanically coupled together and when operated by a key or other device, moves a deadbolt between locked and unlocked positions by means of lock cylinders or other mechanical means. The lock cylinders or other mechanical means are positioned in axially aligned housings, termed "cylinder bodies", which engage the opposite sides of the door. A deadbolt generally is mounted extending from the edge of the door within a tubular housing located in an intersecting bore in the door. Interengaging splines or extensions of the lock cylinders are rotatable with the lock cylinders to operate the deadbolt.

The conventional deadbolt is reciprocated by a mechanical linkage including a drive arm pivotally attached to the deadbolt whereby rotation of the drive spline or tail piece will produce movement of the lock bolt within a housing.

Reference is made to the inventor's prior patent, U.S. Pat. No. 3,934,437, which describes a deadbolt of this design. Various companies manufacture conventional lock bolts of a similar design such as Schlage, Kwikset and Yale.

The problem with conventional deadbolt designs is that the deadbolt has a relatively short length, only about 1½" or less, which length is restricted and dictated by the design and location of the actuating linkage. Generally, in the retracted position, the deadbolt extends inwardly only from the face of the door to approximately the periphery of the bore extending between opposite faces of the door. Also, when conventional deadbolts are in the extended or locked position, only a relatively short portion of their length, about ½" or so, remains within the deadbolt housing. This presents a number of security problems. A relatively short conventional deadbolt can be dislodged by a sharp force applied to one side of the door, causing the lock bolt to become displaced with respect to the actuating mechanism. Further, conventional deadbolt designs are susceptible to attacks by drilling. A would-be intruder can drill an angular hole through the door in the area of the exterior cylinder body and trim ring allowing the insertion of a tool which can easily be manipulated to cause the deadbolt to retract by overcoming the force of the retaining spring and pushing the actuating linkage to the open position.

Therefore, it is apparent there exists a need for an improved high security deadbolt of a design having an extended length substantially greater than conventional deadbolts. The increased length increases security making it much more difficult to attack the lock by drilling or to dislodge the deadbolt by force applied to a face of the door.

SUMMARY OF THE INVENTION

A principle object of the present invention is to provide an improved high security deadbolt lock which has a bolt of substantially increased length and in which the operating or drive mechanism is shielded to effectively deter attacks or tampering.

Briefly, in accordance with the present invention, a high security deadbolt lock assembly is provided which is mounted in a transverse bore extending between the inner and outer surfaces of the door. The deadbolt assembly of the invention is intended for use with a lock cylinder assembly or other mechanical assembly operatively coupled to the deadbolt. The lock cylinder assembly has keyways which are located in either one or both of the oppositely positioned exterior and interior cylinder bodies. The particular construction of the lock cylinder assembly may vary as the deadbolt assembly of the present invention may be utilized with lock cylinder assemblies of various types. The improvement of the present invention resides in the deadbolt assembly which has an elongate housing extending within the door to a location inwardly of the bore extending between the opposite surfaces of the door. This bore receives the lock cylinder assembly. The deadbolt is reciprocal within the housing between extended, locked and retracted, unlocked positions. The bolt is preferably fabricated from a high strength material such as a high quality stainless steel. In the retracted, unlocked position, the deadbolt extends substantially the entire length of the housing. At its inner end, that is the end of the deadbolt within the door, the deadbolt defines a generally U-shaped, inwardly opening recess. A cylindrical actuator member is rotatively supported within the housing within a drive or mounting block which is received and aligned within the recess in the bolt. The actuator is rotatable between locked and unlocked positions by means of the lock cylinder or other mechanical means such as a thumb turn. The actuator member carries a stop, which in the locked position, is rotated into engagement with an axially extending bearing surface of the bolt within the recess. A piston, which is reciprocable within a bore in the mounting block, serves to apply an outwardly biasing force against a flattened bearing surface on the cylindrical actuator member.

The actuator member carries a drive arm which is pivotally secured to one end of a link. The opposite end of the link is pivotally secured to the deadbolt. When the deadbolt is extended to a locked position, a substantial portion of the length of the deadbolt remains confined within the housing. In the locked position, the drive arm and the link are non-axial and are disposed at an angle with respect to one another so that attempts to dislodge or force the bolt inwardly from a locked position are resisted by the engagement of the stop and the bearing surface within the deadbolt recess.

As indicated above, the high security deadbolt of the present invention is resistive to attempts at forcibly dislodging the deadbolt and is also resistive to attempts to penetrate or attack the mechanism by drilling.

Other features and advantages of the present invention will become more apparent from the following specification and claims taken in connection with the accompanying drawings in which:

Description of the Preferred Embodiments

Figure 1D:
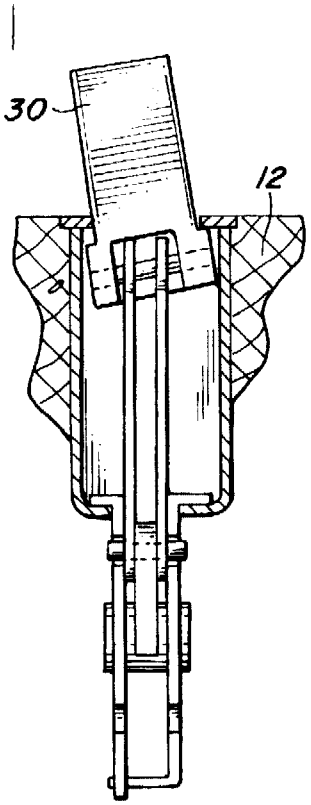
FIG. 1D (PRIOR ART)
FIG. 1D is a view similar to FIG. 1C illustrating the manner in which prior art deadbolts may be forcibly defeated.
Figure 1C:
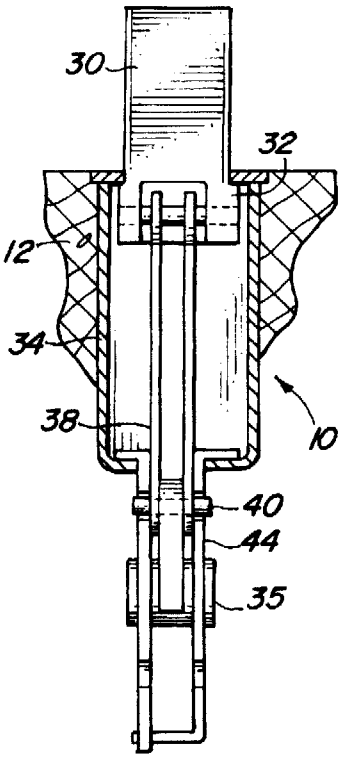
FIG. 1C (PRIOR ART)
FIG. 1C is a top view of the prior art deadbolt design shown in FIG. 1A with the deadbolt being in a normal locked position.
Figure 1B:
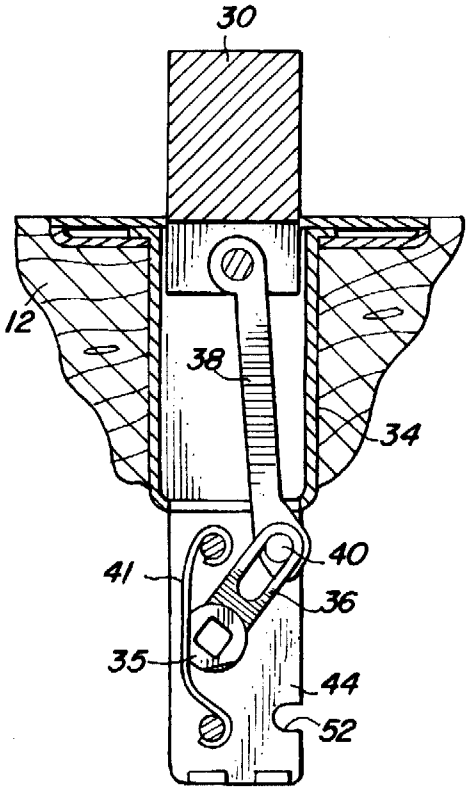
FIG. 1B (PRIOR ART)
FIG. 1B is a view similar to FIG. 1A showing the prior art deadbolt in a locked position.
Figure 1A:
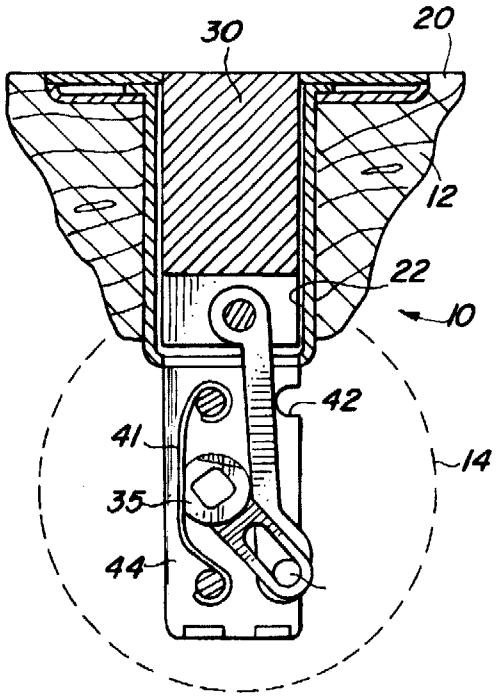
FIG. 1A (PRIOR ART)
FIG. 1A is a side view, partly in section, of a conventional prior art deadbolt design in an open position.

Referring now to the drawings, a deadbolt door lock assembly of conventional design as represented by the prior art is shown in FIGS. 1A to 1D and is generally designated by the numeral 10 and is shown mounted in a door 12 having a transverse bore 14, FIG. 1A, extending between opposite planar surfaces of the door. The edge of the door is represented by the numeral 20 and a bore 22 extends from the edge of the door and intercepts the transverse bore 14.

The cylinder or operating assemblies are not shown as they are well known but when assembled, the operating assemblies, such as a lock cylinder or other mechanical device, are positioned at opposite surfaces of the door and generally have a lip or flange portion which is inserted into the transverse bore 14. Actuating mechanisms such as a spline, cylinder tail piece or other mechanical device extend into the deadbolt assembly and are rotatable by a key engageable in opposite lock cylinders or by a thumb turn, as is well known.

FIGS. 1B to 1D show the deadbolt of the prior art in an extended position. The bolt 30 extends from the housing 34 and is shown as being T-shaped having an inner flange portion 32 which abuts the outer end of the housing 34 in the locked or extended position. The actuating cylinder 35 rotates to extend and retract the actuating link 38 by means of arm 36. In the extended, locked position, linkage pin 40 is received in the outer-most notches 42 in the side plates 44 of the housing. In the retracted or unlocked position, the deadbolt 30 is withdrawn into the housing 34 and the linkage pin 40 is received within inner most notches 52 as seen in FIG. 1A.

It will be appreciated that this design, while commonly used, suffers from a number of disadvantages. When the bolt 30 is extended, only a small portion of the entire length of the deadbolt remains within the housing 34. Therefore, a sharp force or blow applied to either door surface can cause the deadbolt 30 to cock or tilt with respect to the linkage 36 and the housing, as seen in FIG. 1D, rendering the deadbolt inoperative which may permit forced entry.

The conventional deadbolt, as shown in FIGS. 1A to 1D, is also susceptible to attack by drilling. A would-be intruder can easily drill through the door 12 in the area near notches 42, usually at an angle starting above the exterior trim around the lock cylinder. Once a hole is drilled, a tool such as a screwdriver or a lock pick may be inserted and manipulated to move the actuating links 36 and 38 outwardly, overcoming spring 41, causing the bolt to retract from the locked position opening the door.

Referring now to FIGS. 2 to 6, the deadbolt of the present invention is shown and is generally designated by the numeral 100. Deadbolt assembly 100 is shown mounted within a bore 122 extending from the edge of the door 120 and intersecting transverse bore 114. Centerline ℄1 perpendicular to the plane of the door and is located at the center of the transverse bore 144. Centerline ℄2 lies within the door between the opposite door faces on the axial centerline of bore 122. The bores 122 and 114 are positioned to accept installation of the deadbolt components in a manner well known to those skilled in the art.

Figure 2:
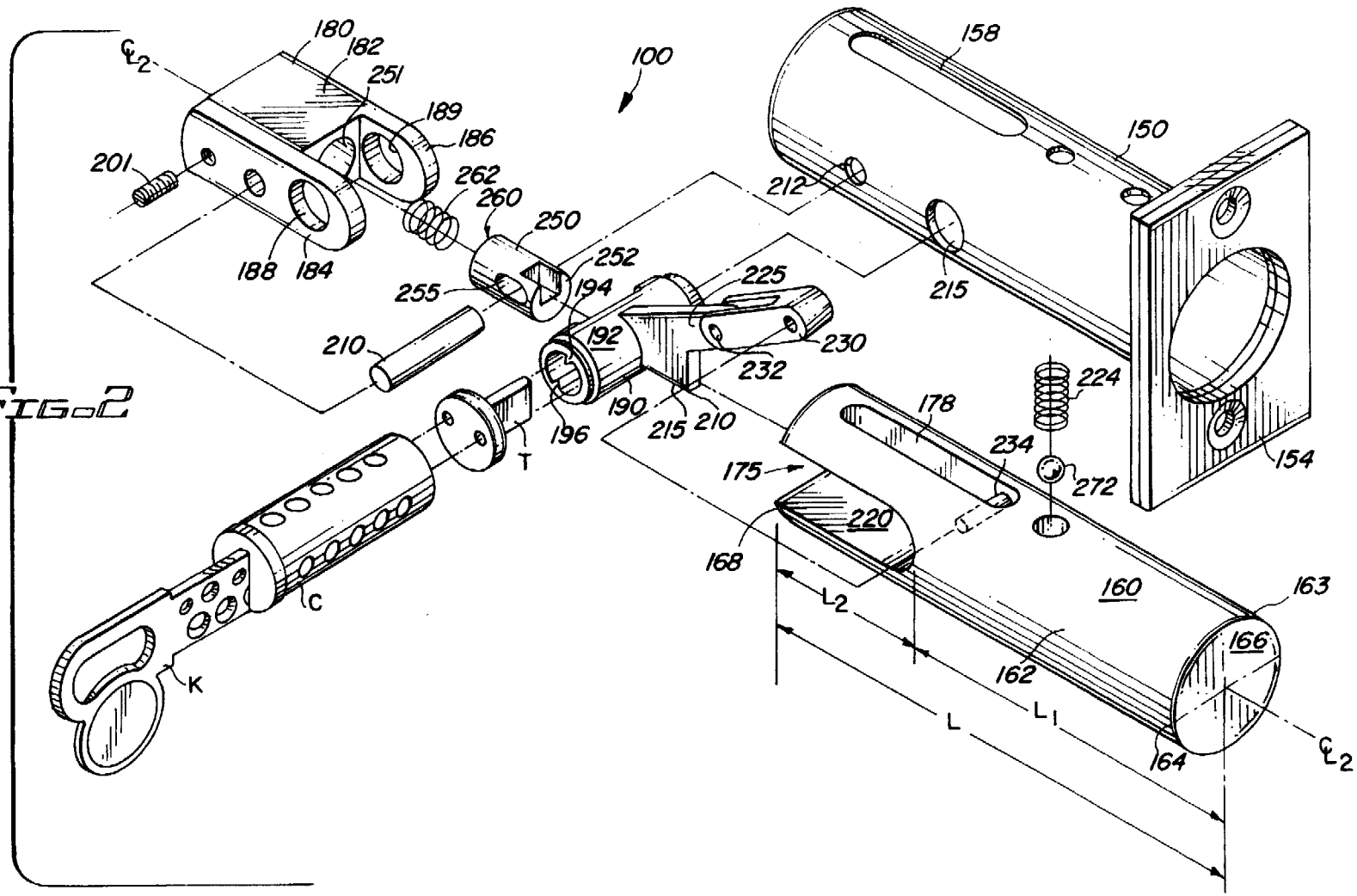
FIG. 2 is an exploded view of the deadbolt assembly of the present invention.

The deadbolt 100 of the present invention can be used in association with various actuating devices. Conventionally, deadbolt locks have an exterior lock cylinder assembly, not shown, at the exterior surface of a door and which has a cylindrical flange which seats in the bore 114 at the exterior side of the door. As seen in FIG. 2, cylinder plug "C" is housed within the lock cylinder assembly and has a spline or tail piece "T" which is rotated when the lock cylinder is key actuated by key "K". Another lock cylinder assembly is provided at the interior surface of the door having an annular flange which fits within the bore 114 at the exterior side. The second lock cylinder is housed within the interior door side assembly and is rotatively retained therein. The interior lock cylinder also includes a tail piece which mates with the interior lock cylinder and may be operated by a key or other means. Guide pins normally are provided to maintain proper orientation of the lock cylinders. The opposed assemblies containing the lock cylinders are secured in place by one or more machine screws extending therebetween or by threaded inserts which are adjustable to accommodate doors of various thickness. Reference is made to the inventor's earlier patent, U.S. Pat. No. 3,934,437, for further detailed discussion of construction of representative lock cylinder assemblies which are mechanically coupled to operate the deadbolt assembly. The deadbolt assembly of the present invention may be actuated by conventional lock cylinders or other means and the particular actuating device are represented by the components K, C and T which components form no part of the invention and are described only to facilitate an understanding of the invention.

Turning to FIGS. 2 to 5, the deadbolt assembly 100 includes a generally elongate housing or casing 150 which houses reciprocal bolt 160. The housing and bolt may be of any suitable cross-sectional shape but generally are circular, as shown, or they may be rectangular provided with rounded corners. The housing 150 is preferably fabricated from a suitable material for security such as stainless steel or brass.

The housing has an overall length "L" which extends substantially from the edge 120 of the door to a location disposed inwardly of the inward extremity of bore 114. Housing 150 is mounted within the bore 122, oriented on centerline ℄2 intermediate the opposite faces of the door. An opening or slot 158 intercepts the upper surface of the housing 150 at a location within the bore. A generally rectangular recess 152 is provided in the door edge 120 and the housing is retained therein by a face plate 154 secured by suitable fasteners 155 depending into the interior door frame. Face plate 154 is mounted in a flush condition with respect to door edge 120.

Figure 3:
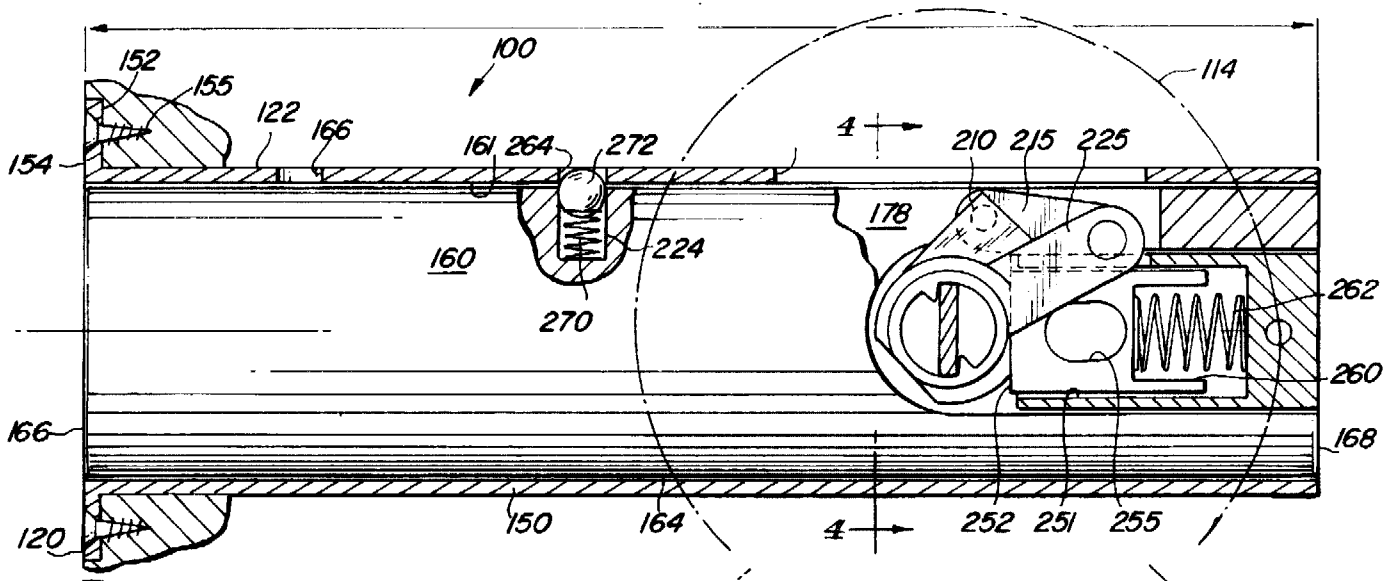
FIG. 3 is a side view, partly in section and broken away, showing the deadbolt assembly of the present invention in an unlocked position.
Figure 5:
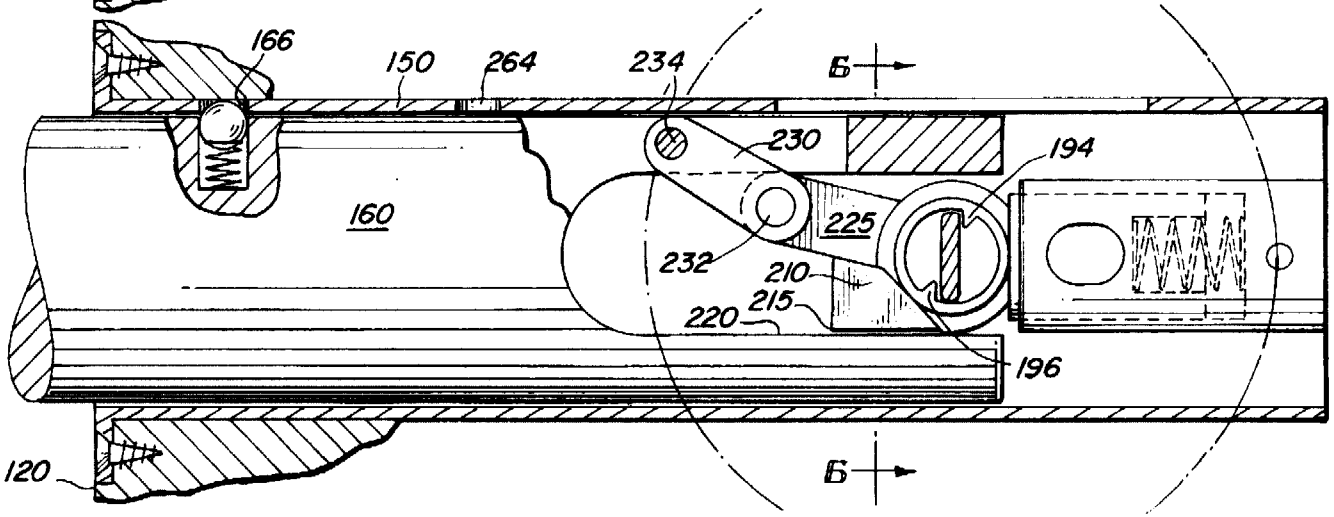
FIG. 5 is a side view of the deadbolt assembly of the present invention in a locked position partly in section and broken away to better illustrate the details.
Figure 4:
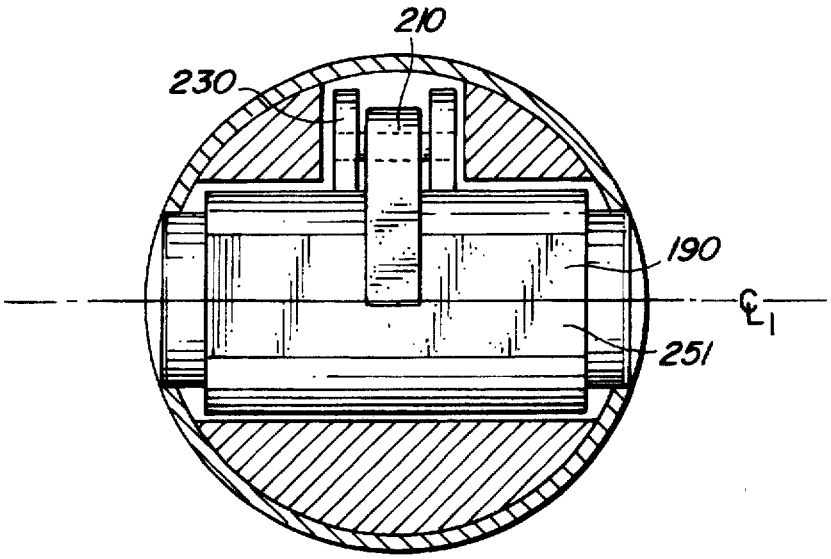
FIG. 4 is a sectional view taken along line 4—4 of FIG. 3.

In FIG. 5, the deadbolt assembly 100 is shown in an extended or locked position and in FIG. 3 the deadbolt is shown in the retracted or unlocked position in which the end is flush with the edge 120 of the door. The deadbolt 160 is reciprocal within the housing 150 between the locked and unlocked positions. The deadbolt 160 has a cross sectional configuration conforming to the shape of the interior of the housing and has a top side 161, opposite sides 162 and 163 and bottom side 164. The bolt has opposite outer and inner ends 166 and 168, respectively. The bolt is also fabricated from a high strength material such as stainless steel.

The length of the bolt in the retracted position extends from the edge 120 of the door to a location inward of the bore 114. The inner end 168 of the bolt defines a U-shaped recess 175 which extends between the bolt sides 162 and 163 and projecting axially inward from the end the bolt approximately one-third of its overall length. The length of the solid core portion of the deadbolt is "L1" whereas "L" is the entire length. "L2" is the length of the end of the deadbolt in which the recess is located. It will be noted that the ratio of "L1" to "L2" is approximately equal to or greater than 2:1.

A vertically extending opening or slot 178 is provided in the upper surface of the bolt intercepting the rearwardly extending recess 175. Opening or slot 178 generally registers with the slot 158 in the housing although slot 158 is longer to accommodate registry of the slots as the bolt reciprocates. The slots cooperate to provide clearance for the drive mechanism as it operates.

A bolt drive mounting block 180 is fixedly secured within recess 175 by means of a pin 210 extending into opposite bores 212 in the housing. The pin 210 may also project beyond the housing wall and be used as an alignment and assembly guide pin. The drive block 180 has a main body 182 and a pair of forwardly extending arms 184 and 186. The arms 184 and 186 each define a transverse bore 188, 189 which rotatively receive the drive cylinder 190. The drive cylinder is accessed by opposite bores 218 in the housing 150. The drive cylinder 190 has an annular body 192 with a pair of opposed projections 194 and 196 which are engageable by actuator members such as a tail piece "T" as seen in FIG. 2. For convenience of assembly, arm 184 is fabricated as a separate component and secured to the body 182 by machine screws 201 extending into body 182.

Figure 6:
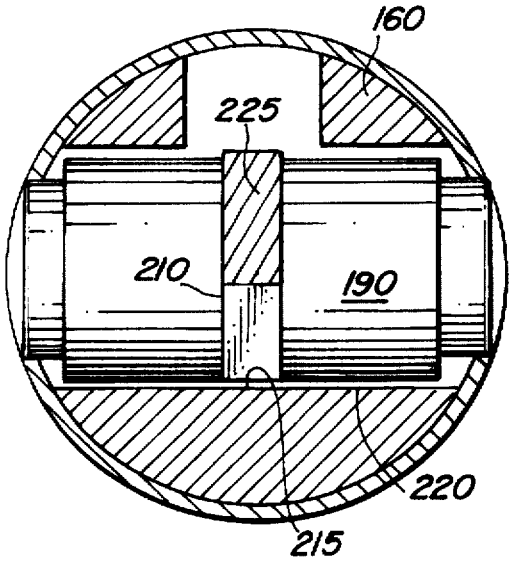
FIG. 6 is a sectional view taken along line 6—6 of FIG. 5.

Stop 210 is carried on the exterior of the drive cylinder and has a generally flat bearing surface 215 which, in the locked position as seen in FIGS. 5 and 6, engages the lower surface 220 of the recess 175. In the unlocked position, seen in FIGS. 3 and 4, the stop 210 has been rotated clockwise over 180° extending into the area of the slot 178 in the top of the deadbolt 160. While a single stop is shown, multiple stops may be arranged on the drive cylinder.

The exterior of the drive cylinder also carries a radially extending bolt drive arm 225. In the locked position, the drive arm extends upwardly towards the edge of the do or at an angle of approximately 30° with respect to the centerline ℄2, as best seen in FIG. 5. The end of the drive arm is pivotally connected to link 230 at pin 232. The opposite end of link 230 is pivotally connected to the bolt 160 at pivot pin 234. In the locked position, with the bolt extended, the bolt drive arm and pivot pin are non-axial with the center of pivot pin 232 being under center disposed below a line extending from the center of drive cylinder 190 and pivot pin 234. It will be appreciated that any inward force applied to the deadbolt 160 will be transmitted to pivot pin 234 and, in turn, to pivot pin 232 applying a counterclockwise rotational force to the bolt drive arm and cylinder. Rotation of the drive arm will be resisted by the engagement of the stop 210 against the bearing surface 220 of the recess 175. Also, since the drive arm and link are housed within recess 175, they are effectively shielded from attempts to attack the deadbolt mechanism by drilling from the exterior.

It will also be appreciated that the unique construction of the deadbolt assembly allows the length along of the bolt to be substantially greater than conventional bolts. Also, for additional security and strength, the inner end of the housing 150 extends inwardly of the bore 114. When locked, the elongated deadbolt is fully engaged within the housing 160 extending inwardly of ℄1 so that the bolt is securely retained and resistant to being forcibly dislodged or cocked in the manner of previous prior art deadbolts.

A biasing member acts against the exterior of the drive cylinder and includes a piston 250 extending axially within a bore 251 in the drive block. The end of the piston has a flattened end 252 which abuts a flattened bearing surface 251 at the exterior of the cylinder. An elongate, somewhat axially-extending oval shaped opening 255 extends transversely in the piston and pin 210 extends through the opening and is fixed to the housing and may project beyond the housing side wall as explained above. A blind bore 260 is provided in the inner end of the piston and receives a biasing spring 262 to urge the piston into engagement with the cylinder. The biasing force urges the deadbolt to a locked position as the key or other actuating means is turned to lock the deadbolt and also provides tactile resistance as the deadbolt is unlocked.

One or more detents may be provided to yield a positive indication to the user that the deadbolt has been turned to either the locked or unlocked position. To this end, a transverse blind bore 270 extends in the upper surface of the deadbolt at a location corresponding to opening 166 in the housing 160 when the bolt is locked and corresponding to opening 264 when the bolt is unlocked. A detent ball 272 is received within the blind bore and a biasing spring 224 is captured in the bottom of the blind bore engaging the bottom surface of the ball. It will be seen that when the bolt is moved to the locked position as shown in FIG. 5, the thrust applied will overcome force exerted by the spring 224 allowing the bolt to be locked. When the bolt reaches the locked position, the detent ball 272 will assume a position seated in bore 166 in the housing as shown in FIG. 5.

The construction and unique features of the deadbolt of the present invention provide a high security bolt assembly. It will be appreciated that the deadbolt is resistant to drill attacks since the drive mechanism is inaccessible from the exterior. A would-be intruder attempting to drill through the door will encounter the housing or the substantially solid core portion of the deadbolt. Attempts at dislodging the deadbolt by sharp blows applied to one face of the door or the other will be resisted as the deadbolt in the locked position has a substantial portion of its length in engagement with the housing so that attempts to forcibly dislodge the bolt will be resisted by the bolt housing and door.

With normal deadbolts, the depth of engagement or "throw" is generally only about one inch. Typically, the overall length of the deadbolt of the present invention is approximately 5" and approximately two-thirds of the length of the bolt remains engaged within the housing when the bolt is in the locked position. Therefore, the present invention provides an improved deadbolt which receives the bolt actuating components in a position that is shielded or protected within a recess at the rear or inner end of the bolt. This unique construction provides security and is extremely efficient and compact which allows the bolt to be of substantially greater length than conventional bolts which positions much of the mechanism inwardly of the bolt inner end. The deadbolt of the present invention also is a design compatible with many presently existing locks and may be retrofit using existing lock components with minimum installation.

It will be apparent to those skilled in the art to make various changes, alterations and modifications to the deadbolt invention described herein. To the extent that such changes, alterations and modifications do not depart from the spirit and scope of the appended claims, they are intended to be encompassed therein.

I claim:

1. A high security deadbolt assembly for installation in a door having actuating means receivable in a first transverse bore extending between the opposite door faces, said deadbolt comprising:

(a) an elongate housing securable in the door in a second bore extending inwardly from the edge of the door and intercepting said first transverse bore;

(b) a generally elongate bolt having an outer and an inner end and reciprocable within the said housing between a retracted, unlocked position and an extended, locked position;

(c) said bolt defining a recess at said inner end;

(d) a bolt drive arm rotatably disposed within said housing on a generally cylindrical drive member which drive member is rotatable by said actuator means between said locked and unlocked positions;

(e) stop means carried on said cylindrical drive member;

(f) an abutment surface on said bolt within said recess positioned to be engaged by said stop means in said locked position;

(g) link means pivotally secured to said bolt drive arm and to said bolt defining an angle with respect to said bolt drive arm when said bolt is in said extended locked position whereby forces applied to said bolt are resisted by engagement of said stop means with said abutment surface;

(h) biasing means engaging said housing and applying a biasing force to said drive member; and (i) said drive member and biasing means being positioned on a mounting block fixedly positioned and aligned with said recess.

2. The deadbolt assembly of claim 1 wherein said recess is generally U-shaped.

3. The deadbolt assembly of claim 1 wherein said deadbolt is stainless steel.

4. The deadbolt assembly of claim 1 wherein said deadbolt housing has a length greater than the distance from the edge of the door to the inner-most location of the transverse bore.

5. The deadbolt assembly of claim 2 wherein said mounting block is fixedly secured by a retaining pin extending through registering bores in said block and said housing.

6. The deadbolt assembly of claim 1 wherein said biasing means includes a piston reciprocable in a bore and engaging said drive member and spring means acting against said piston urging it against said drive member.

7. A high security deadbolt assembly for installation in a door having a transverse bore for receiving an actuator assembly, said deadbolt comprising:

(a) a housing securable in the door in a bore extending from the edge of the door and intercepting said transverse bore;

(b) a bolt reciprocally received in said housing and moveable between a locked and an unlocked position, said bolt having opposite inner and outer ends and defining a, recess having a surface at the inner end thereof;

(c) a bolt drive rotatable by said actuator assembly and disposed in said housing;

(d) a link connecting said bolt drive to said bolt, said link and bolt being disposed in a non-linear relationship when in a locked position;

(e) biasing means applying a biasing force to said bolt drive;

(f) said bolt drive being positioned in said recess and said biasing means being positioned on a mounting block fixedly positioned and aligned with said recess (g) whereby rotation of the bolt drive actuates the link which, in turn, reciprocates the deadbolt relative to the housing.

8. The deadbolt assembly of claim 7 wherein said deadbolt has an axial length "L", a solid core axial length "L1", and wherein said recess has an axial length "L2", wherein L1/L2 is greater than 2:1.

9. The deadbolt assembly of claim 7 wherein said bolt drive includes abutment means for engaging said surface of said recess in a locked position.

10. The deadbolt assembly of claim 7 further including biasing means acting against said bolt drive means.

11. The deadbolt assembly of claim 7 wherein the throw of the deadbolt is approximately one-third of its axial length.

12. The deadbolt assembly of claim 7 wherein said housing and said bolt are substantially the same length.

13. The deadbolt assembly of claim 7 wherein said housing and bolt define an axial extending centerline and said drive arm is generally axially aligned therewith.

* * * * *